United States Patent [19]

Pfeil

[11] Patent Number: 4,673,430

[45] Date of Patent: Jun. 16, 1987

[54] METHOD FOR THE PRODUCTION OF NICKEL POWDER

[75] Inventor: Leonard B. Pfeil, Birmingham, England

[73] Assignee: Inco Limited, Toronto, Canada

[21] Appl. No.: 737,085

[22] Filed: Mar. 25, 1947

[30] Foreign Application Priority Data

Apr. 4, 1946 [GB] United Kingdom ..... 10505/46

[51] Int. Cl.[4] ..... B22F 1/00

[52] U.S. Cl. ..... 75/0.5 AA; 75/62; 75/251

[58] Field of Search ..... 75/22, 0.5, 33, 72, 75/62, 0.5 AA, 251

[56] References Cited

U.S. PATENT DOCUMENTS

| | | | |
|---|---|---|---|
| 1,710,141 | 4/1929 | Benner et al. | 423/244 |
| 1,759,661 | 5/1930 | Müller et al. | 75/0.5 AB |
| 1,815,846 | 7/1931 | Joseph | 423/244 |
| 1,836,732 | 12/1931 | Schlecht et al. | 75/0.5 AB |

OTHER PUBLICATIONS

Wulff, *Powder Metallurgy,* American Society for Metals, (1942), pp. 55–60.

Mittasch *Zeitschriff fur Physikalische Chemie,* vol. 40, pp. 69–70, (1902), QD1.245.

Berthelot, Annalo de Chemie et de Physique, 6th Sec., vol. 26, p. 567 (1892).

*Primary Examiner*—Stephen J. Lechert, Jr.

*Assistant Examiner*—Anne Brookes

*Attorney, Agent, or Firm*—Raymond J. Kenny; Edward A. Steen; Francis J. Mulligan, Jr.

EXEMPLARY CLAIM

1. An improved method for producing fine nickel powder having a substantially spherical form and size ranging from about 3 microns to about 7 microns, containing sulphur within a critical range of about 0.02% to about 0.05%, and possessing an improved degree of smoothness and susceptibility for the production of sintered nickel articles of controlled porosity and uniformly good mechanical properties and for uniform sintering at lower sintering temperatures and in shorter sintering periods than when conventional particles of carbonyl decomposed nickel powders are used which comprises vaporizing about one hundred parts per hour of liquid nickel carbonyl into a decomposition vessel having an internal pressure equal to about eight inches of water (gauge), simultaneously introducing about twenty parts of hydrogen sulphide gas per hour at a pressure of about one-half inch of water (gauge) into said vessel, and thermally decomposing the mixture of nickel carbonyl vapor and hydrogen sulphide gas at a temperature of about 280° C. to about 310° C. to produce said fine nickel powder containing said sulphur within said critical range.

3. As a new article of manufacture, an improved carbonyl decomposed nickel powder possessing an improved degree of smoothness and susceptibility for the production of sintered nickel articles of controlled porosity and uniform good mechanical properties and for sintering at lower sintering temperatures and in shorter sintering periods than when conventional sulphur-free particles of carbonyl decomposed nickel powder are used, said powder constituted of finely divided particles having a substantially spherical form and a size within a range of about 3 microns to about 7 microns and containing a small amount of sulphur within a range of about 0.004% to about 0.1%.

4 Claims, No Drawings

METHOD FOR THE PRODUCTION OF NICKEL POWDER

The present application relates to metal powders and it relates more particularly to a method for the preparation of nickel powder by the decomposition of nickel carbonyl.

In the preparation of nickel powder by the decomposition of nickel carbonyl for use in the manufacture by sintering of articles and products as heretofore practiced in the prior art, it has usually been found desirable to produce the powder in the purest form possible since it has been believed that impurities, in particular carbon and sulphur, had an undesirable effect on the properties of the sintered product.

This invention is based on the discovery that it is highly desirable for nickel powder intended for use in the manufacture of sintered products to contain small and controlled amounts of sulphur.

According to the present invention, in the production of nickel powder by the decomposition of nickel carbonyl, the powder is produced with a sulphur content between 0.004 and 0.1% sulphur, the preferred sulphur content being 0.01 and 0.05%. The sulphur may be introduced into the nickel powder produced by the decomposition of nickel carbonyl by introducing a sulphur-containing gas, such as hydrogen sulphide, into the decomposition vessel with the nickel carbonyl vapor. The sulphur-containing gas may be introduced prior to or during the said decomposition. Alternatively sulphur vapor or a solid sulphide which will dissociate under the conditions of decomposition may be introduced into the decomposer. The decomposition of nickel carbonyl within the decomposition vessel is carried out at a temperature of from about 270° C. to 325° C.

It is believed that the sulphur present in the nickel particles, and particularly the sulphur present in the surface layers of the particles, functions as an adhesion assistor during the initial stages of the sintering step and is partially or substantially wholly eliminated as sintering progresses, the degree of elimination of the sulphur increasing with an increase in sintering temperature. Whether or not this belief is correct, the optimum sulphur content appears to depend on the size of the nickel particles, being less as the particle size increases. Since it is at the surface of the nickel particles that the sulphur content is most important, the decomposition of the nickel carbonyl may be so carried out that sulphur is either absent or present in only a small amount when the decomposition begins so that particles free from or low in sulphur are produced and act as nuclei on which nickel richer in sulphur is subsequently deposited in the presence of an increased amount of sulphur. For the same reason the decomposition may, if desired, be carried out in two completely separate stages.

The presence of the specified amounts of sulphur results in uniform sintering of the articles throughout the mass at a lower sintering temperature and in a shorter sintering period than is required when the nickel powder particles are sulphur-free. This uniformity of sintering is generally desirable in all processes in which finished articles are produced from powdered metals by sintering but is particularly important in the production of sheet or strip in which controlled porosity and uniformly good mechanical properties are required.

A further advantage resulting from the use of the process of the present invention is that the sulphur-containing nickel powder particles are, in general, smooth, which further assists in improving the sintering properties of the powder and the mechanical properties of the sintered product. A milling operation to produce smooth particles, which is usually considered a desirable step, is therefore shortened or rendered unnecessary.

As illustrative examples of the preparation of sulphur-containing nickel powder in accordance with the method of the present invention, reference is made to Examples 1 to 3.

EXAMPLE 1

100 liters per hour of liquid nickel carbonyl were vaporised into the top of an externally heated hollow vessel, or decomposer, of 1 meter diameter and 4 meters long. At the point of entry of the vapour into the decomposer, 20 liters per hour of hydrogen sulphide were injected at a pressure of about 12 inches water gauge, and against an internal decomposer pressure equal to 8" water gauge. The mixture of carbonyl vapor and hydrogen sulphide mixture was thermally decomposed at 280° C., yielding in 8 hours 360 kilos of nickel powder containing 0.05% sulphur and having a mean particle size of 6 microns. During this time there was regenerated from the thermally decomposed carbonyl vapour 554 cubic meters (NTP) of carbon monoxide.

The particle size is dependent on the temperature of decomposition. When this temperature was raised to 310° C., the other conditions being as in Example 1, the sulphur content of the powder remained 0.05% but the mean particle size was reduced to 3 microns.

A reduction in the sulphur content can be effected either by reducing the amount of sulphur-containing gas or by introducing it in a different manner.

EXAMPLE 2

The procedure in this case was the same as that in Example 1, except that instead of causing the hydrogen sulphide to be injected at the point of entry of the vapor into the decomposer it was introduced through the side walls of the vessel in such a way that it became incorporated in the carbon monoxide gas circulating within the decomposer. The mean particle size of the powder was again 6 microns but the average sulphur content was only 0.02%, since the initial formation of the nickel particles took place in the presence of little or no sulphur.

EXAMPLE 3

100 liters per hour of liquid nickel carbonyl were passed into a vaporizing vessel containing an internal steam-heating coil and the carbonyl vapor was led into the decomposer. At the point of entry of the carbonyl vapor into the decomposer 8 liters per hour of carbonyl sulphide (COS) were injected. The internal temperature of the decomposer was maintained at 270° C. The resultant nickel powder contained 0.025% of sulphur and had a mean particle size of 7 microns.

Although the decomposition of the nickel carbonyl in association with a sulphur-containing gas may be carried out at pressures up to 2 or 3 atmospheres, such pressures are not essential as is indicated in the foregoing illustrative examples.

Although the present invention has been described and illustrated in connection with certain specific embodiments thereof, variations and modifications may be made by those skilled in the art without departing from the invention as defined in the following claims.

I claim:

1. An improved method for producing fine nickel powder having a substantially spherical form and size ranging from about 3 microns to about 7 microns, containing sulphur within a critical range of about 0.02% to about 0.05%, and possessing an improved degree of smoothness and susceptibility for the production of sintered nickel articles of controlled porosity and uniformly good mechanical properties and for uniform sintering at lower sintering temperatures and in shorter sintering periods than when conventional particles of carbonyl decomposed nickel powders are used which comprises vaporizing about one hundred parts per hour of liquid nickel carbonyl into a decomposition vessel having an internal pressure equal to about eight inches of water (gauge), simultaneously introducing about twenty parts of hydrogen sulphide gas per hour at a pressure of about one-half inch of water (gauge) into said vessel, and thermally decomposing the mixture of nickel carbonyl vapor and hydrogen sulphide gas at at a temperature of about 280° C. to about 310° C. to produce said fine nickel powder containing said sulphur within said critical range.

2. An improved method for the production of nickel powder having a substantially spherical form and size ranging from about 3 microns to about 7 microns, containing sulphur within a range of about 0.004% to about 0.1%, and possessing an improved degree of smoothness and susceptibility for the production of sintered nickel powders of controlled porosity and uniformly good mechanical properties and for uniform sintering at lower sintering temperatures and for shorter periods than when conventional particles of carbonyl decomposed nickel powders are used which comprises vaporizing nickel carbonyl into a decomposition vessel in a continuous operation and at a temperature of about 270° C. to about 325° C., introducing into the decomposition vessel a sulphur-containing gas, controlling the amount of said sulphur-containing gas to a very small fraction of the amount of nickel carbonyl undergoing decomposition so as to cause the occurrence of an extremely small critical amount of sulphur in the nuclei of said particles of nickel powder, subsequently increasing the amount of sulphur-containing gas in a second stage of said decomposing operation to a higher amount so as to cause the occurrence of a small and increased amount of sulphur in the surface layers of said particles, the amount of sulphur in said surface layers being higher than the amount in said nuclei, and continuing said decomposing operation within the said vessel at a temperature of about 270° C. to about 325° C. so that the total amount of sulphur content of said particles is within the critical range of about 0.004% to about 0.1%.

3. As a new article of manufacture, an improved carbonyl decomposed nickel powder possessing an improved degree of smoothness and susceptibility for the production of sintered nickel articles of controlled porosity and uniform good mechanical properties and for sintering at lower sintering temperatures and in shorter sintering periods than when conventional sulphur-free particles of carbonyl decomposed nickel powder are used, said powder constituted of finely divided particles having a substantially spherical form and a size within a range of about 3 microns to about 7 microns and containing a small amount of sulphur within a range of about 0.004% to about 0.1%.

4. As a new article of manufacture, an improved carbonyl decomposed nickel powder possessing an improved degree of smoothness and susceptibility for the production of sintered nickel articles of controlled porosity and uniformly good mechanical properties and for sintering at lower sintering temperatures and in shorter sintering periods than when conventional sulphur-free particles of carbonyl decomposed nickel powder are used and consisting of particles having a substantially spherical form and size within a range of about 3 microns to about 7 microns, said particles being composed of nuclei having a lesser sulphur content and outer layers having a predominant sulphur content and containing a total amount of sulphur in each particle within a critical range of about 0.004% to about 0.1%.

* * * * *